US006305527B1

(12) United States Patent
Bungter

(10) Patent No.: US 6,305,527 B1
(45) Date of Patent: Oct. 23, 2001

(54) APPARATUS FOR CONVEYING COILER CANS, PARTICULARLY BETWEEN TWO DRAWING FRAMES POSITIONED CONSECUTIVELY IN A SLIVER PROCESSING LINE

(75) Inventor: Helmut Bungter, Viersen (DE)

(73) Assignee: Trützschler GmbH & Co. KG, Mönchengladbach (DE)

( * ) Notice: Subject to any disclaimer, the term of this patent is extended or adjusted under 35 U.S.C. 154(b) by 0 days.

(21) Appl. No.: 08/915,721

(22) Filed: Aug. 21, 1997

(30) Foreign Application Priority Data

Aug. 22, 1996 (DE) ..... 196 33 823
May 30, 1997 (DE) ..... 197 22 581

(51) Int. Cl.[7] ..... B65G 25/00
(52) U.S. Cl. ..... 198/465.2; 19/459 A
(58) Field of Search ..... 198/465.2, 580, 198/465.1, 867.01; 19/459 A

(56) References Cited

U.S. PATENT DOCUMENTS 4,714,153 12/1987 Bischofberger .
5,311,645 5/1994 Schwalm et al. .

FOREIGN PATENT DOCUMENTS 39 08 833 9/1990 (DE) .
41 16 083 11/1991 (DE) .
41 28 374 7/1992 (DE) .
92 10 330 1/1993 (DE) .
44 28 247 2/1996 (DE) .
52 999 12/1996 (DE) .
0 610 794 8/1994 (EP) .
2 668 758 5/1992 (FR) .
941219 11/1963 (GB) .
2 302 103 1/1997 (GB) .

*Primary Examiner*—James R. Bidwell
(74) *Attorney, Agent, or Firm*—Venable; Gabor J. Kelemen

(57) ABSTRACT

An apparatus for conveying coiler cans, includes a first conveyor track having an outlet end; a first conveying device for moving the coiler cans on and along the first conveyor track; a second conveyor track having an inlet end and being arranged at generally right angles to the first conveyor track; a second conveying device for moving the coiler cans on and along the second conveyor track; a first drive for operating the first and second conveying devices; a separate transfer device for moving a coiler can from the outlet end of the first conveyor track into the inlet end of the second conveyor track; and a second drive for operating the transfer device.

15 Claims, 4 Drawing Sheets

FIG. 3a
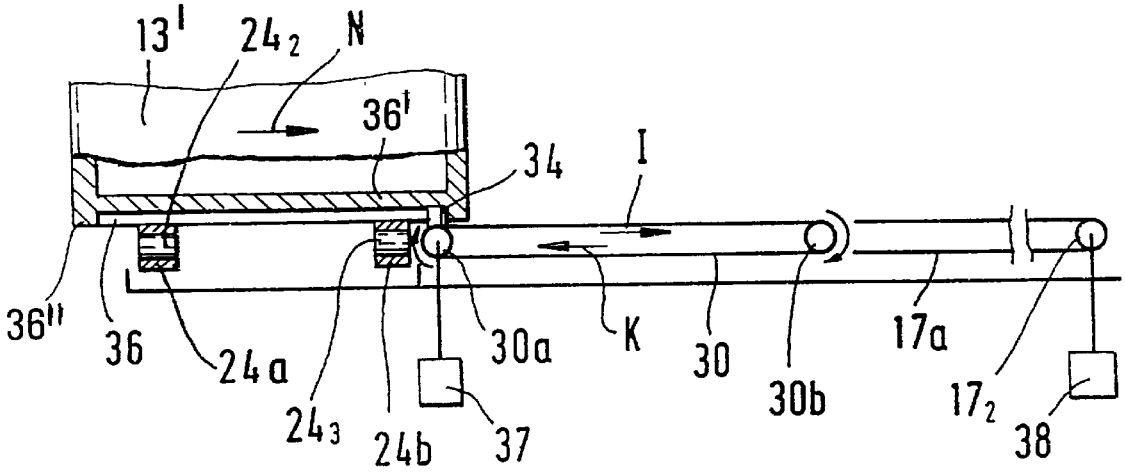
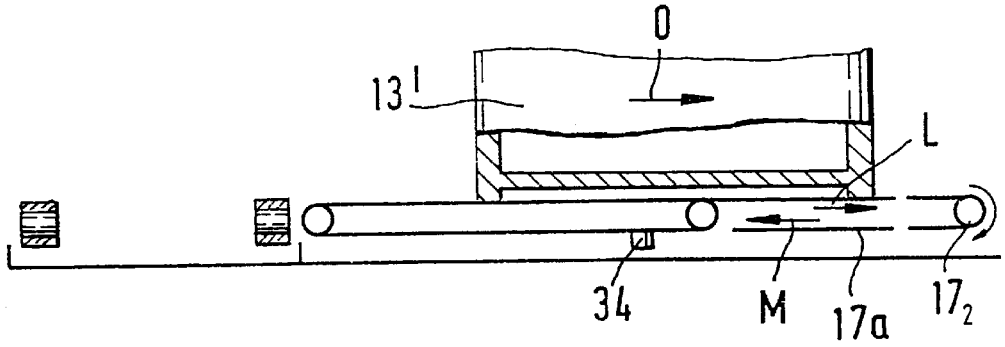
FIG. 3b

APPARATUS FOR CONVEYING COILER CANS, PARTICULARLY BETWEEN TWO DRAWING FRAMES POSITIONED CONSECUTIVELY IN A SLIVER PROCESSING LINE

CROSS REFERENCE TO RELATED APPLICATION

This application claims the priority of German Application Nos. 196 33 823.9 filed Aug. 22, 1996 and 197 22 581.0 filed May 30, 1997, which are incorporated herein by reference.

BACKGROUND OF THE INVENTION

This invention relates to an apparatus for conveying and readying coiler cans, particularly between two consecutive drawing frames of a processing line. The apparatus is of the type which includes a first conveyor track having, for the coiler cans, a first conveying device extending along the conveyor track. A second conveyor track having a second conveying device extends perpendicularly from the first conveyor track for a transverse conveyance of the coiler cans. A can carrier element is provided for transferring the coiler cans from the first (incoming) conveyor track to the second (transverse) conveyor track.

In a known apparatus as disclosed in German Offenlegungsschrift (application published without examination) 41 30 463 the second (transverse) conveyor track has a guide track having a central guide slot. Underneath the guide track a conveyor chain circulates on which coiler can carriers are mounted in fixed distances. The carriers project from the guide slot to such an extent that they are capable of engaging and pulling the coiler cans situated on the conveyor track. The upper run of the chain moves towards a drawing frame. A chain-supporting end sprocket is arranged in such a manner underneath the can delivery station that a can carrier which emerges from the guide slot at the end sprocket engages the coiler can at its lower edge and thus may pull the empty coiler can on the first conveyor track. The second conveying device of the second (transverse) conveyor track may be switched on only if the chain of the first conveying device is stationary and a coiler can is in a suitable position. The two conveying devices are operatively coordinated with one another by means of a control device in such a manner that one coiler can is always situated at the mouth of the conveying device. During the conveyance of the coiler cans the conveyor chain must always be positioned such that no coiler can carrier projects from the guiding slot at the transfer location. The second (transverse) conveying device is switched on only when an empty coiler can to be transferred comes to a halt, and then a coiler can carrier of the chain pulls the coiler can at the coiler can bottom edge from the first conveying device of the first conveyor track into the second conveying device of the second (transverse) conveyor track. It is a disadvantage of such prior art structures that the two conveying devices are necessarily coupled to one another to perform a coordinated operation, that is, they are not independent from one another. It is a further drawback that because of the fixed distances of the coiler can carriers from one another an accumulation of the coiler cans on the second (transverse) conveyor track is not possible.

SUMMARY OF THE INVENTION

It is an object of the invention to provide an improved apparatus of the above-outlined type from which the discussed disadvantages are eliminated and which, in particular, makes possible a mutually independent motion of the first (supplying) conveying device and the second (transverse) conveying device and also makes possible an accumulation of the coiler cans.

This object and others to become apparent as the specification progresses, are accomplished by the invention, according to which, briefly stated, the apparatus for conveying coiler cans includes a first conveyor track having an outlet end; a first conveying device for moving the coiler cans on and along the first conveyor track; a second conveyor track having an inlet end and being arranged at generally right angles to the first conveyor track; a second conveying device for moving the coiler cans on and along the second conveyor track; a first drive for operating the first and second conveying devices; a separate transfer device for moving a coiler can from the outlet end of the first conveyor track into the inlet end of the second conveyor track; and a second drive for operating the transfer device.

By virtue of the fact that a separate transfer device is associated with the conveying devices of the two perpendicularly arranged conveyor tracks, an independent motion of the two conveying devices is possible. In this manner, a separation of functions is effected: the transfer of the coiler cans from the first conveyor track to the second conveyor track and the conveyance of the coiler cans thereon are performed by two different devices. Further, in contrast to the known apparatus, the conveying devices do not have a plurality of coiler can carriers, so that an accumulation of the coiler cans (for example, in a mutually contacting relationship) is advantageously feasible.

BRIEF DESCRIPTION OF THE DRAWINGS

FIGS. 3*a* and 3*b* are sectional views taken along line III—III of FIG. 2 illustrating a coiler can in two different positions.

DESCRIPTION OF THE PREFERRED EMBODIMENT

Figure 1:
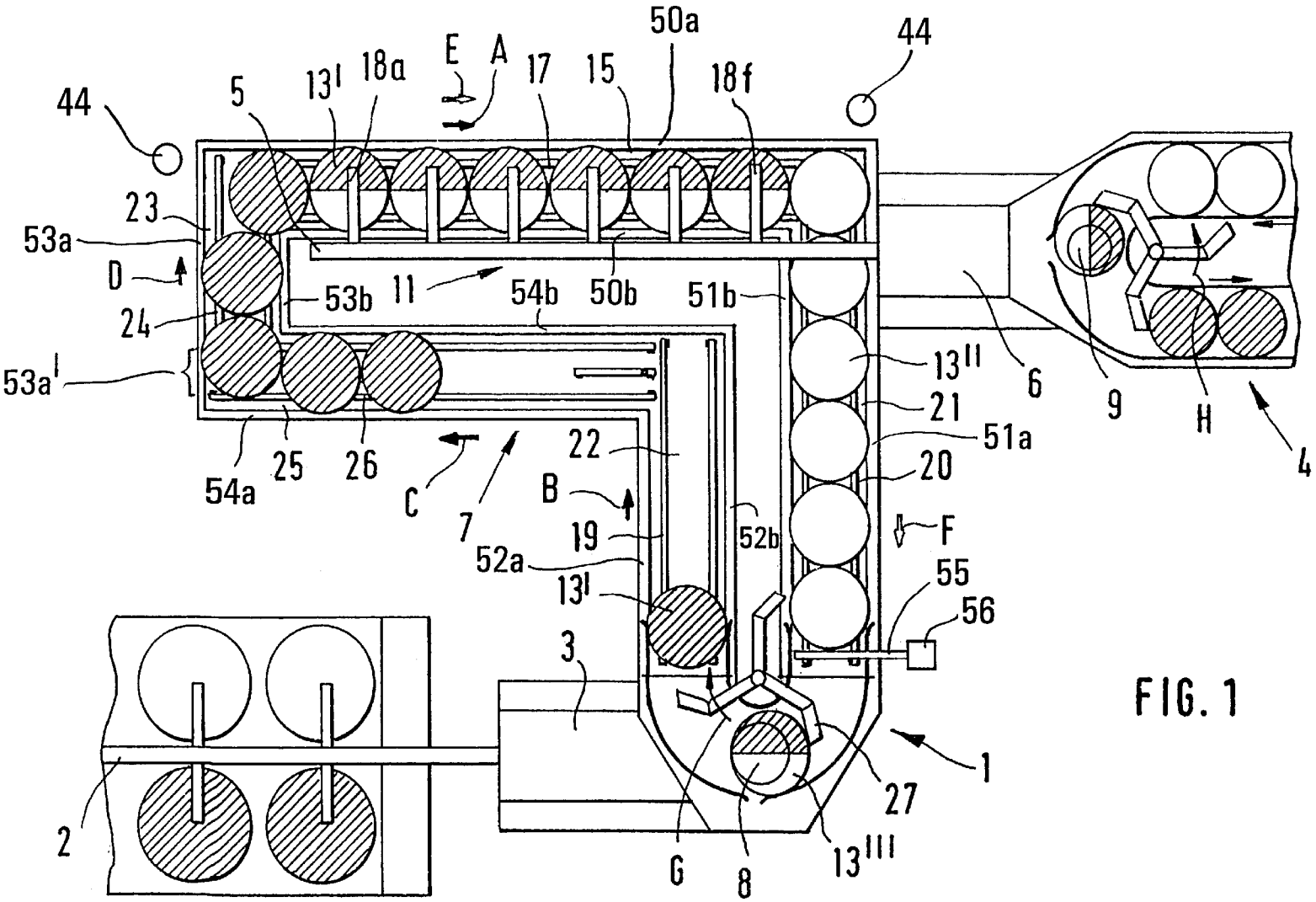
FIG. 1 is a schematic top plan view of a coiler can conveyor system according to the invention.

Turning to FIG. 1, two drawing frames 1 and 4 of a sliver processing line are arranged in series wherein the drawing frame 1 is the upstream machine and the drawing frame 4 is the downstream machine as viewed in the order of consecutive sliver processing. The drawing frame 1 has an intake table 2, a drawing unit 3 and a sliver depositing device 8 (having a rotary coiler head), whereas the drawing frame 4 has an intake table 5, a drawing unit 6 and a sliver depositing device 9 (having a rotary coiler head). The drawing frame 1 and/or 4 may be an HS model manufactured by Trützschler GmbH & Co. KG, Mönchengladbach, Germany.

Figure 4:
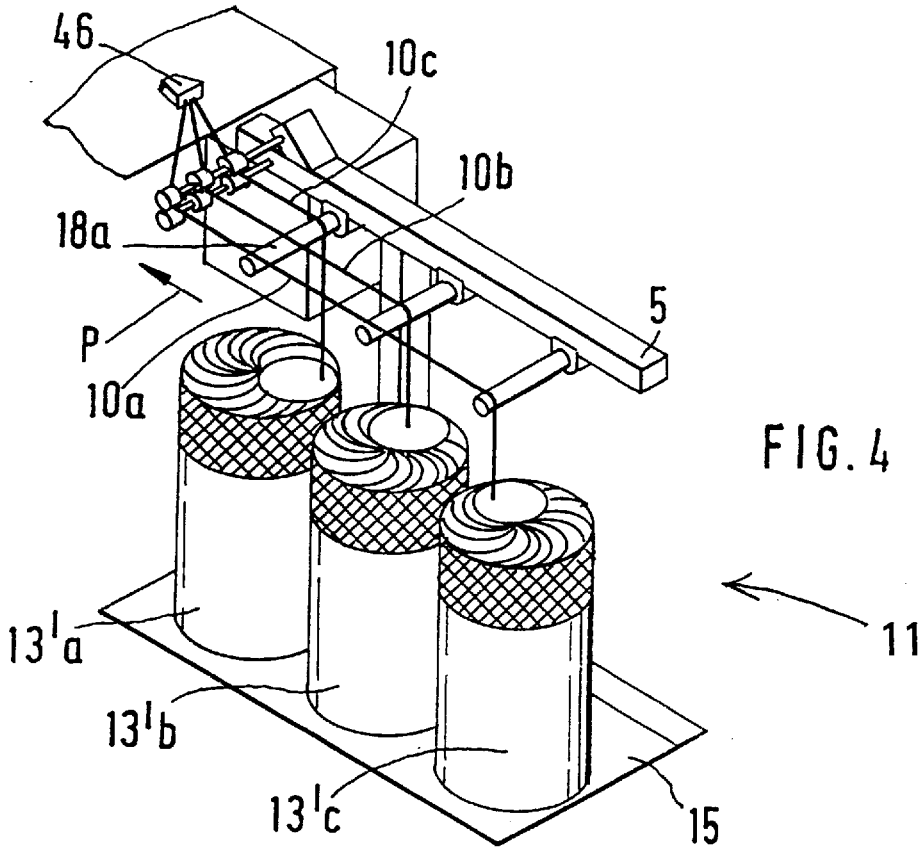
FIG. 4 is a schematic perspective view of an intake table of a drawing frame, showing coiler cans in an operational position.

Also referring to FIG. 4, the drawing unit 6 of the downstream drawing frame 4 is supplied with sliver 10 from coiler cans 13'*a*, 13'*b* and 13'*c* standing in a creel row 11 underneath supply rollers 18*a*–18*f* of an intake table 5. The coiler cans are supported in the creel row 11 on a conveyor track 15. To the sliver delivery device 8 of the upstream drawing frame 1 there extends a conveyor track (supply track) 21 from an outlet end of the creel row 11 for supplying empty cans to the sliver delivery device 8. A conveyor track (removal track) 22 for the sliver-filled cans extends from the sliver delivery device 8. The conveyor track 15 is arranged perpendicularly to the supply track 21 and the removal track 22. A conveyor track 23 and the removal track 22 are connected with one another by means of a further conveyor track 25. The conveyor tracks 15, 21, 22, 23 and 25 have respective conveying devices 17, 20, 19, 24 and 26 for moving the coiler cans along the conveyor tracks.

The coiler can conveyor system 7 thus comprises essentially the conveyor track 15, the supply conveyor track 21, the removal conveyor track 22 and the conveyor tracks 23 and 25 which are all joined end-to-end and form a closed-circuit track assembly arranged in a rectangular pattern such that the conveyor track 15 extends parallel to the conveyor track 25 whereas the conveyor tracks 21, 22 and 23 are parallel to one another. The solid-line arrows A, B, C and D indicate the path of conveyance of the full cans 13' whereas the outlined (empty) arrows E and F indicate the path of conveyance of the empty cans 13". The empty cans 13" are pushed by a rotary coiler can exchanger (turnstile) 27 which rotates in the direction G, from the supply track 21 to underneath the rotary coiler head of the sliver delivery device 8. At that location the cans are then filled with sliver 10 (13'" indicates a partially filled can) and thereafter they are pushed as full cans 13' by the turnstile 27 onto the removal track 22. The coiler cans 13', 13" which circulate in the closed coiler can system are conveyed in a forward direction as indicated by the arrows A–F. The arrangement of the coiler can conveying system shown in FIG. 1 is particularly space saving.

Figure 2:
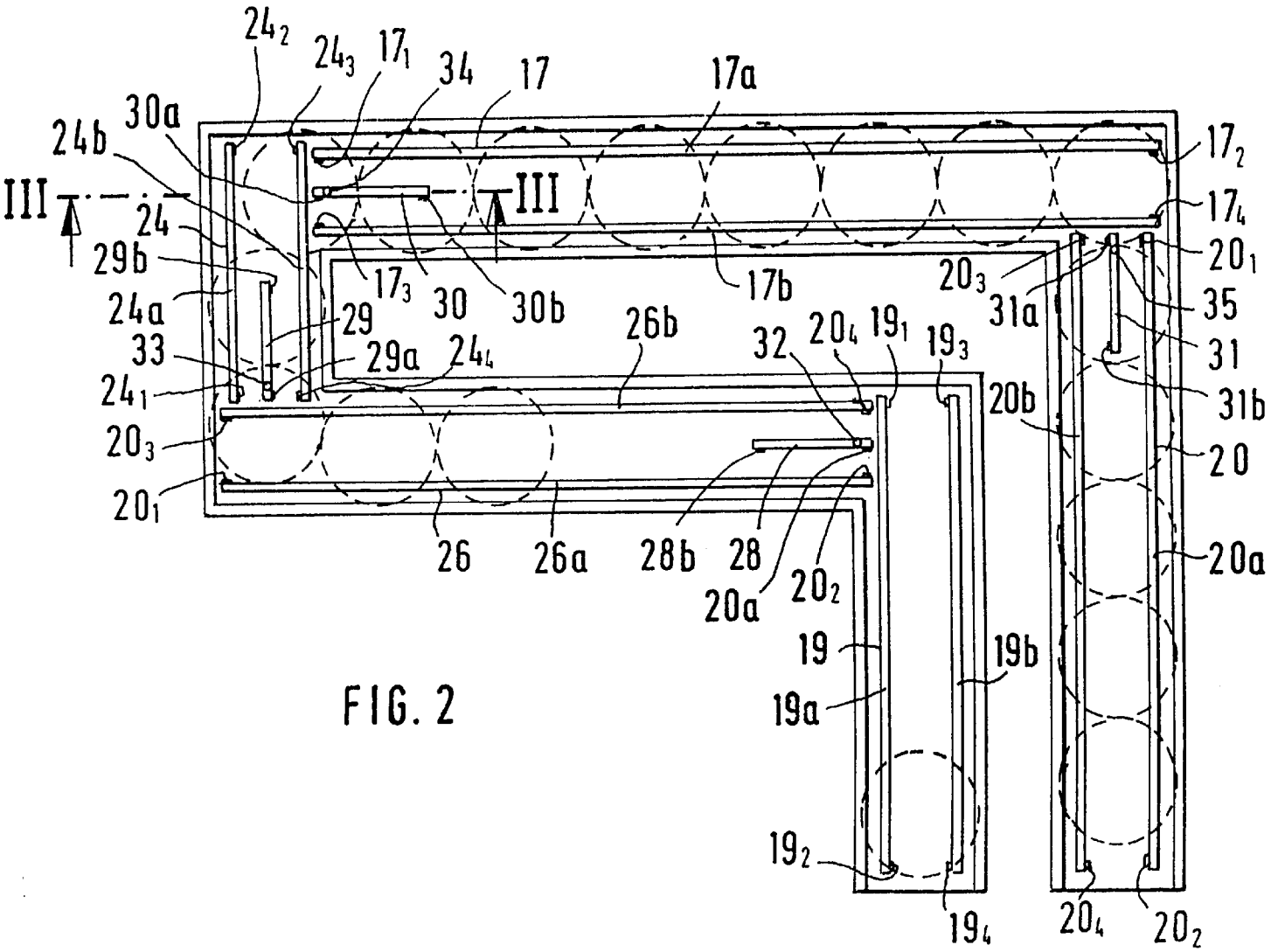
FIG. 2 is an enlarged schematic top plan view of one part of the structure of FIG. 2, showing additional details.

According to FIG. 2, the conveying devices 17, 19, 20, 24 and 26 are arranged close to the floor. Each conveying device has two parallel running conveyor belts 17*a*, 17*b*; 19*a*, 19*b*; 20*a*, 20*b*; 24*a*, 24*b* and 26*a*, 26*b* which circulate about end rollers $\mathbf{17}_1$ to $\mathbf{17}_4$; $\mathbf{19}_1$ to $\mathbf{19}_4$; $\mathbf{20}_1$ to $\mathbf{20}_4$; $\mathbf{24}_1$ to $\mathbf{24}_4$ and $\mathbf{26}_1$ to $\mathbf{26}_4$. The conveying devices may be designed, for example, as described in published German Patent Application 195 09 928.1. The end rollers of the belts of the same belt pair are, at each belt end, arranged coaxially to one another.

Considering FIGS. 1 and 2 together, between two adjoining conveyor tracks 22, 25; 25, 23; 23, 15; and 15, 21 a respective, short circulating endless transfer belt 28, 29, 30 and 31 is provided to function as a can transfer device. In each instance the can transfer device is arranged on the receiving conveyor track of the two adjoining conveyor tracks. Thus, the transfer belt 28 is arranged on the conveyor track 25 to receive cans from the conveyor track 22; the transfer belt 29 is arranged on the conveyor track 23 to receive cans from the conveyor track 25; the transfer belt 30 is arranged on the conveyor track 15 to receive cans from the conveyor track 23; and the transfer belt 31 is arranged on the conveyor track 21 to receive cans from the conveyor track 15. The transfer belts 28, 29, 30 and 31 which circulate about end rollers 28*a*, 28*b*; 29*a*, 29*b*; 30*a*, 30*b*; and 31*a*, 31*b* are arranged parallel to the conveyor belts 26*a*, 26*b*; 24*a*, 24*b*; 17*a*, 17*b*; and 20*a*, 20*b*, respectively. In each instance, the end roller at the inlet end of the transfer belt is in alignment with the end rollers at the inlet ends of the respective conveyor belts. Expediently, the outer surface of the upper run of the transfer belts 28, 29, 30 and 31 is at a slightly lower height level than that of the outer faces of the upper runs of the respective conveyor belts 26*a*, 26*b*; 24*a*, 24*b*; 17*a*, 17*b*; and 20*a*, 20*b*, and further, the effective length of each transfer belt 28, 29, 30 and 31 approximately corresponds to the diameter of the coiler cans. At the outer face of each transfer belt 28, 29, 30 and 31 a respective carrier element such as a pin 32, 33, 34 and 35 is arranged which, when situated on the upper run of the associated transfer belt, projects upwardly beyond the height level of the transporting surface of the respective conveyor from which transfer by the transfer belt is effected. The arrows A through F indicate the direction of motion of the upper belt run of the conveyor belts and the transfer belts associated with the respective conveyor belts.

As shown in FIG. 3*a*, a can 13' is situated on the conveyor belts 24*a*, 24*b* at the end of the conveyor track 23. The coiler can has a bottom 36' from which extends a peripheral, downwardly oriented terminal rim 36" which, together with the underface of the can bottom 36', defines a depression 36. The can 13' projects laterally outwardly beyond the conveyor belts 24*a*, 24*b* and thus the end roller 30*a* of the transfer belt 30 is situated underneath that region of the coiler can 13' which projects laterally beyond the conveyor belt 24*b*. When the coiler can 13' is in its position shown in FIG. 3*a*, on a command signal an electric motor 37 sets the transfer belt 30 in motion such that its upper and the lower runs move in the direction of the arrows I and K, respectively. As a result of this operation, the coiler can carrier 34 moves on the end roller 30*a* from below upwardly and projects into the depression 36 of the coiler can. As the transfer belt 30 continues to move, the can carrier 34 engages the inside face of the can rim 36" and pulls the coiler can 13' in the direction N from the conveyor belts 24*a*, 24*b* of the conveyor track 23 onto the conveyor belts 17*a*, 17*b* of the conveyor track 15. As the carrier 34 reaches the end of the upper run of the transfer belt 30, it travels downwardly out of its operational range about the end roller 30*b* and then travels in the reverse direction on the lower run of the transfer belt 30 as shown in FIG. 3*b*. At the same time, the conveyor belts 17*a*, 17*b* of the conveyor track 15, circulated by the drive motor 38 move the coiler can 13' forwardly in the direction O (designated at A and E in FIG. 1). The transfer belts 28, 29 and 31 operate identically to the transfer belt 30 to shift coiler cans onto the respective conveyor tracks 25, 23 and 21.

As shown in FIGS. 1 and 4, and as described earlier, the conveyor track 15 forms part of the creel row 11 where the coiler cans are positioned for feeding the drawing unit 6 of the drawing frame 4 in the direction P, through a sliver guide (sliver intake trumpet) 46.

Figure 5:
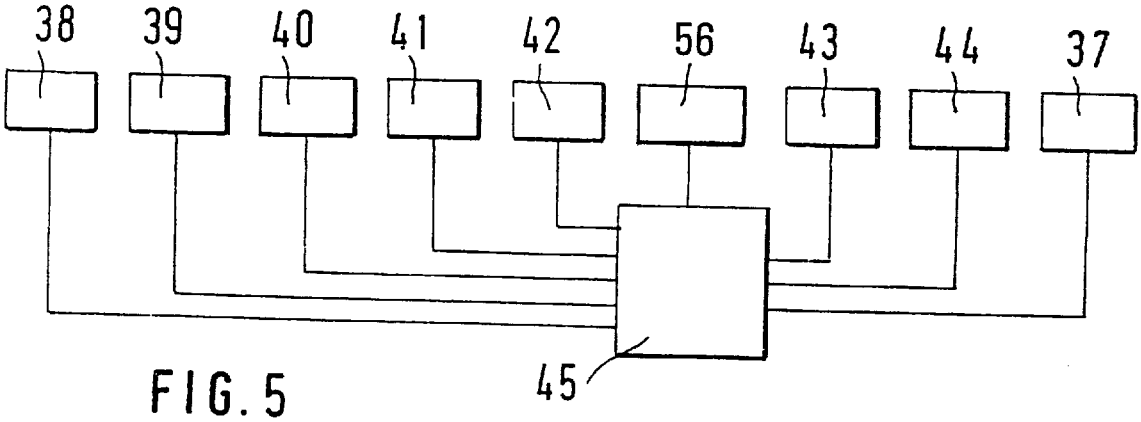
FIG. 5 is a block diagram illustrating the control of the various drives and components for the conveyor system according to the invention.

In FIG. 5 an electronic control and regulating device 45 such as a microcomputer is shown to which there are connected the driving devices 38–42, for example, drive motors for the serially arranged conveying devices 19, 26, 24, 17 and 20, the drive motor 43 for the turnstile 27, sensors 44 for the path control of the coiler cans 13', 13" and drive motors (such as drive motor 37) for the transfer devices 28, 29, 30, 31. The sensors 44 may be located, for example, such that they emit a signal when a coiler can reaches the outlet end of a conveying device. Such sensors 44 are shown, for example, at the outlet end of the conveyor track 23 and at the outlet end of the conveyor track 15. Such signal may be utilized for initiating the motion of the respective transfer belt 28, 29, 30 or 31. The can conveying system 7 thus permits an automatic can conveyance and can replacement during operation between the drawing frames 1 and 4.

By virtue of the independently driven conveying devices of the various conveyor tracks as well as the transfer devices, the electronic control and regulating device 45, by means of a suitable energization and deenergization of the drives, makes possible an accumulation of the coiler cans on all or selected ones of conveyor tracks. In such an accumulated state the coiler cans are situated single file, in a mutually contacting position, as shown for the conveyor tracks 15, 21, 23 and 25 in FIG. 1. To achieve such an accumulated, mutually contacting state of the coiler cans, it is necessary to prevent motion of a selected can on the conveyor track to thus allow the conveying device to bring up consecutive cans behind the arrested can. In this manner the conveying device (that is, the conveyor belts on which the coiler cans stand) will slide underneath the stopped cans and will bring consecutively additional cans to be stopped by the coiler can immediately ahead. In the embodiment shown in FIG. 1, the conveyor tracks which join each other perpendicularly, include a lateral guide rail on each side. Thus, the conveyor track 15 has lateral guide rails 50*a*, 50*b*; the conveyor track 21 has lateral side rails 51*a*, 51*b*; the conveyor track 22 has lateral side rails 52*a*, 52*b*; the conveyor track 23 has lateral side rails 53*a*, 53*b*; and the conveyor track 25 has lateral side rails 54*a*, 54*b*.

The lateral guide rails provide, at the outlet end of the conveyor tracks 15, 22, 23 and 24 a stop or abutment so that in case the transfer device at the inlet of the adjoining conveyor track is idle, the coiler can at the outlet of the preceding conveyor track will be immobilized, thus allowing the cans to accumulate therebehind. For example, the side rail zone 53*a'* of the side rail 53*a* will abut and stop any coiler can arriving at the outlet end of the conveyor track 25, provided that the transfer device 29 the conveyor track 23 is idle. Similar side rail zones serve as stops for the coiler cans arriving at the outlet end of the conveyor tracks 15, 22 and 23.

For abutting and stopping a coiler can at the outlet end of the conveyor track 21, that is, within the operating range of the turnstile 27, expediently a gate 55 is provided, having a control unit 56, connected to the electronic control and regulating device 45 as shown in FIG. 5. The gate 55 may be in a lowered, operative position in which it acts as a stop for the leading coiler can on the conveyor track 21 whereas in its raised, inoperative position it will allow the turnstile 27 to move the coiler can away from the conveyor track 21. It is noted that such a coiler can arresting and releasing arrangement is disclosed in U.S. Pat. application Ser. No. 08/617,328 filed Mar. 28, 1996 which is hereby incorporated by reference. It will be understood that the gating device 55, 56, may be arranged at any desired location of a selected conveyor track.

It will be understood that the above description of the present invention is susceptible to various modifications, changes and adaptations, and the same are intended to be comprehended within the meaning and range of equivalents of the appended claims.

What is claimed is:

1. An apparatus for conveying coiler cans, comprising (a) a first conveyor track having an outlet end;

(b) a first conveying device for moving the coiler cans on and along said first conveyor track;

(c) a second conveyor track having an inlet end adjoining said outlet end of said first conveyor track; said first conveyor track and said second conveyor track being arranged at generally right angles to one another;

(d) a second conveying device for moving the coiler cans on and along said second conveyor track;

(e) first drive means for operating said first and second conveying devices;

(f) a separate transfer device for moving a coiler can from said outlet end of said first conveyor track into said inlet end of said second conveyor track;

(g) second drive means for operating said transfer device; and (h) circulating means for moving the coiler cans unidirectionally in an endless path; said circulating means including said first and second conveying devices and said first drive means.

2. The apparatus as defined in claim 1, further comprising (h) sensor means for generating a signal when a coiler can reaches a predetermined position on said first and second conveyor tracks; and (i) an electronic control and regulating device; said first and second drive means and said sensor means being connected to said electronic control and regulating device.

3. The apparatus as defined in claim 1, further comprising abutting means for arresting a coiler can on at least one of said conveyor tracks to cause coiler cans to accumulate behind the arrested coiler can in a mutually contacting relationship.

4. The apparatus as defined in claim 1, wherein said transfer device comprises an endless transfer belt extending parallel to said second conveyor track and a carrier element mounted on said transfer belt for hooking into a coiler can situated at said outlet end of said first conveyor track and for moving the coiler can from said first conveyor track into said inlet end of said second conveyor track.

5. The apparatus as defined in claim 4, wherein said second conveying device comprises two parallel-spaced endless conveyor belts extending parallel to said second conveyor track; said conveyor belts having lower runs and can-carrying upper runs together moving the coiler cans standing thereon; said transfer belt being situated between said conveyor belts and extending parallel thereto; said carrier element being arranged for hooking into the coiler can from below.

6. The apparatus as defined in claim 5, wherein said conveyor belts of said second conveying device and said transfer belt have inlet ends and outlet ends supported by end rollers; said end rollers being in alignment with one another at said inlet ends.

7. The apparatus as defined in claim 5, wherein said transfer belt is a generally horizontally-oriented endless belt having upper and lower runs; said second drive means being arranged such as to move said upper run of said transfer belt codirectionally with said upper runs of said second conveying device away from said first conveyor track.

8. The apparatus as defined in claim 7, in combination with a coiler can having a can diameter; said transfer belt having a length approximately equaling said can diameter.

9. The apparatus as defined in claim 8, wherein said coiler can further comprises a recess provided underneath said can bottom; said carrier element being arranged for engaging into said recess when said carrier element is situated on said upper run of said transfer belt.

10. The apparatus as defined in claim 7, wherein said first conveying device comprises two parallel-spaced endless conveyor belts extending parallel to said first conveyor track; said conveyor belts of said first conveying device having lower runs and can-carrying upper runs together moving the coiler cans standing thereon; and further wherein said upper run of said transfer belt is situated at a lower height level than said upper runs of said conveyor belts of said first conveying device.

11. The apparatus as defined in claim 10, wherein said carrier element projects upwardly beyond said can-carrying upper runs of said first conveying device when said carrier element is situated on said upper run of said transfer belt.

12. In a system including a first drawing frame having a sliver output where sliver from the first drawing frame is deposited in coiler cans;

a second drawing frame having a sliver input where sliver is supplied to said second drawing frame from sliver-filled coiler cans; and a conveyor apparatus for supplying sliver-filled coiler cans from the output of said first drawing frame to the input of said second drawing frame and for supplying empty coiler cans from the input of said second drawing frame to the output of said first drawing frame;

the improvement wherein said conveyor apparatus comprises (a) a first conveyor track having an outlet end;

(b) a first conveying device for moving the coiler cans on and along said first conveyor track;

(c) a second conveyor track having an inlet end adjoining said outlet end of said first conveyor track; said first conveyor track and said second conveyor track being arranged at generally right angles to one another;

(d) a second conveying device for moving the coiler cans on and along said second conveyor track;

(e) first drive means for operating said first and second conveying devices;

(f) a separate transfer device for moving a coiler can from said outlet end of said first conveyor track into said inlet end of said second conveyor track;

(g) second drive means for operating said transfer device; and (h) circulating means for moving the coiler cans unidirectionally in an endless path; said circulating means including said first and second conveying devices and said first drive means.

13. The system as defined in claim 12, wherein said conveyor apparatus comprises a plurality of end-to-end arranged conveyor tracks; one of said conveyor tracks being said first conveyor track and another of said conveyor tracks being said second conveyor track; further wherein said second drawing frame includes a creel row for positioning sliver-filled coiler cans at said input; one of said conveyor tracks forming part of said creel row.

14. A system comprising (a) a first fiber processing machine having a sliver-discharging output;

(b) a second fiber processing machine having a sliver-receiving input; and (c) an apparatus for conveying coiler cans to said input and said output; said apparatus including (1) a conveyor defining an endless conveying path; said conveyor including (i) a first conveyor track having an outlet end and forming a part of said endless conveying path;

(ii) a second conveyor track having an inlet end adjoining said outlet end of said first conveyor track; said second conveyor track forming a part of said endless conveying path; said first conveyor track and said second conveyor track being arranged at generally right angles to one another;

(iii) a first conveying device for moving the coiler cans on and along said first conveyor track;

(iv) a second conveying device for moving the coiler cans on and along said second conveyor track;

(2) a drive assembly for moving the coiler cans at all times unidirectionally in said endless path; said drive assembly including first drive means for operating said first and second conveying devices;

(3) a separate transfer device for moving a coiler can from said outlet end of said first conveyor track into said inlet end of said second conveyor track; and (4) second drive means for operating said transfer device.

15. An apparatus for conveying coiler cans, comprising (a) a first conveyor track having an outlet end;

(b) a first conveying device for moving the coiler cans on and along said first conveyor track;

(c) a second conveyor track having an inlet end adjoining said outlet end of said first conveyor track; said first conveyor track and said second conveyor track being arranged at generally right angles to one another;

(d) a second conveying device for moving the coiler cans on and along said second conveyor track; said second conveying device including two parallel-spaced endless conveyor belts extending parallel to said second conveyor track; said conveyor belts having lower runs and can-carrying upper runs together moving the coiler cans standing thereon; said conveyor belts of said second conveying device having inlet ends and outlet ends supported by end rollers;

(e) first drive means for operating said first and second conveying devices;

(f) a separate transfer device for moving a coiler can from said outlet end of said first conveyor track into said inlet end of said second conveyor track; said transfer device including (1) an endless transfer belt extending parallel to said second conveyor track; said transfer belt being situated between said conveyor belts and extending parallel thereto; said transfer belt having an inlet end and an outlet end each supported by end rollers; said end rollers of said transfer belt and said end rollers of said conveyor belts of said second conveying device being in alignment with one another at said inlet ends; and (2) a carrier element mounted on said transfer belt for hooking, from below, into a coiler can situated at said outlet end of said first conveyor track and for moving the coiler can from said first conveyor track into said inlet end of said second conveyor track; and (g) second drive means for operating said transfer device.

* * * * *